US007789154B2

(12) United States Patent
Davis

(10) Patent No.: US 7,789,154 B2
(45) Date of Patent: Sep. 7, 2010

(54) EDUCTOR JET BUSHING FOR DOWNHOLE USE

(75) Inventor: John P. Davis, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/833,584

(22) Filed: Aug. 3, 2007

(65) Prior Publication Data

US 2009/0032247 A1 Feb. 5, 2009

(51) Int. Cl.
*E21B 37/00* (2006.01)
*E21B 37/08* (2006.01)
*E21B 21/14* (2006.01)

(52) U.S. Cl. ..... 166/312; 166/222; 166/99

(58) Field of Classification Search ..... 166/222, 166/223, 298, 55.1, 55.6, 99, 107, 312, 376; 175/312

See application file for complete search history.

(56) References Cited

U.S. PATENT DOCUMENTS

| | | | | |
|---|---|---|---|---|
| 3,198,256 | A * | 8/1965 | Kirby, II | 166/99 |
| 4,693,504 | A | 9/1987 | Baker | |
| 5,327,974 | A | 7/1994 | Donovan et al. | |
| 5,944,100 | A | 8/1999 | Hipp | |
| 6,276,452 | B1 | 8/2001 | Davis et al. | |
| 7,472,745 | B2 * | 1/2009 | Lynde et al. | 166/99 |

* cited by examiner

*Primary Examiner*—Jennifer H Gay
*Assistant Examiner*—Brad Harcourt
(74) *Attorney, Agent, or Firm*—Steve Rosenblatt

(57) ABSTRACT

A jet bushing for a wellbore cleanup tool features a jet looking uphole to reduce turbulence at the outlet ports that look downhole to accommodate the recirculation flow around the tool that captures the cuttings. The uphole oriented port keeps the pumped fluid downhole from having to make a u-turn to get back uphole and reduces turbulence to allow a higher recirculation flow at the tool to pick up and capture cuttings within the tool.

12 Claims, 3 Drawing Sheets

EDUCTOR JET BUSHING FOR DOWNHOLE USE

FIELD OF THE INVENTION

The field of the invention is downhole debris cleanup devices that can remove such things as milling debris and more particularly tools that employ eductor principles to induce recirculation to capture the debris.

BACKGROUND OF THE INVENTION

Devices for capture of milling debris generally involve the concept of circulation of fluid downhole so that cuttings carried by the fluid get captured in a screen while the cutting free flow continues to the surface. In essence, if the pump rate from the surface is for example 2 barrels a minute, a downhole recirculation rate of double that amount or more occurs through a screen. U.S. Pat. No. 6,276,452 illustrates that this is accomplished with a device called a jet bushing which takes the pressurized clean fluid pumped downhole and directs it downwardly and radially out through housing ports in the tool. This action induces flow laden with cuttings to enter the tool below a screen so that the cuttings can be retained as the fluid continues through the screen.

FIG. 1 is a partial view of the tool illustrated in U.S. Pat. No. 6,276,452 in the area of the jet bushing to show the problem addressed by the present invention. It shows part of a casing 10 and part of a tool body 12 that holds the jet bushing 14. A series of downwardly and outwardly facing openings 16 are aligned with matching ports 18 so that flow represented by arrow 20 can make a lateral exit in the downhole direction. This arrangement is akin to the nozzles 34 in U.S. Pat. No. 6,276,452 sending flow through aligned ports 24. Referring again to FIG. 1 a recirculation flow pattern is set up as indicated by arrow 22 going down the annulus 24 and coming back up the tool through a screen (not shown) in a central passage 26 as represented by arrows 28. Of course, the flow rate going into the tool represented by arrow 30 has to be the same as the flow rate coming back up to the surface represented by arrow 32, assuming no fluid losses downhole. It should be noted that the flow represented by arrow 20 has to come back up the hole as shown by arrow 32. However, at the port 18 that flow mixes with recirculating flow 28 and that reversal of direction to go uphole in the same region as the recirculation flow is trying to go downhole causes turbulence that reduces the overall recirculation flow 28.

Thus, the present invention optimizes the configuration of the jet bushing to optimize the recirculation flow by decreasing the turbulence created by the prior design. It simply provides at least one nozzle oriented uphole to accommodate the recirculation loop without any part of it having to reverse direction after exiting the tool housing. These features will be more readily understood by those skilled in the art from a review of the description of the preferred embodiment and the associated drawing with the understanding that the claims are the full measure of the invention.

SUMMARY OF THE INVENTION

A jet bushing for a wellbore cleanup tool features a jet looking uphole to reduce turbulence at the outlet ports that look downhole to accommodate the recirculation flow around the tool that captures the cuttings. The uphole oriented port keeps the pumped fluid downhole from having to make a u-turn to get back uphole and reduces turbulence to allow a higher recirculation flow at the tool to pick up and capture cuttings within the tool.

DETAILED DESCRIPTION OF THE PREFERRED EMBODIMENT

Figure 1:
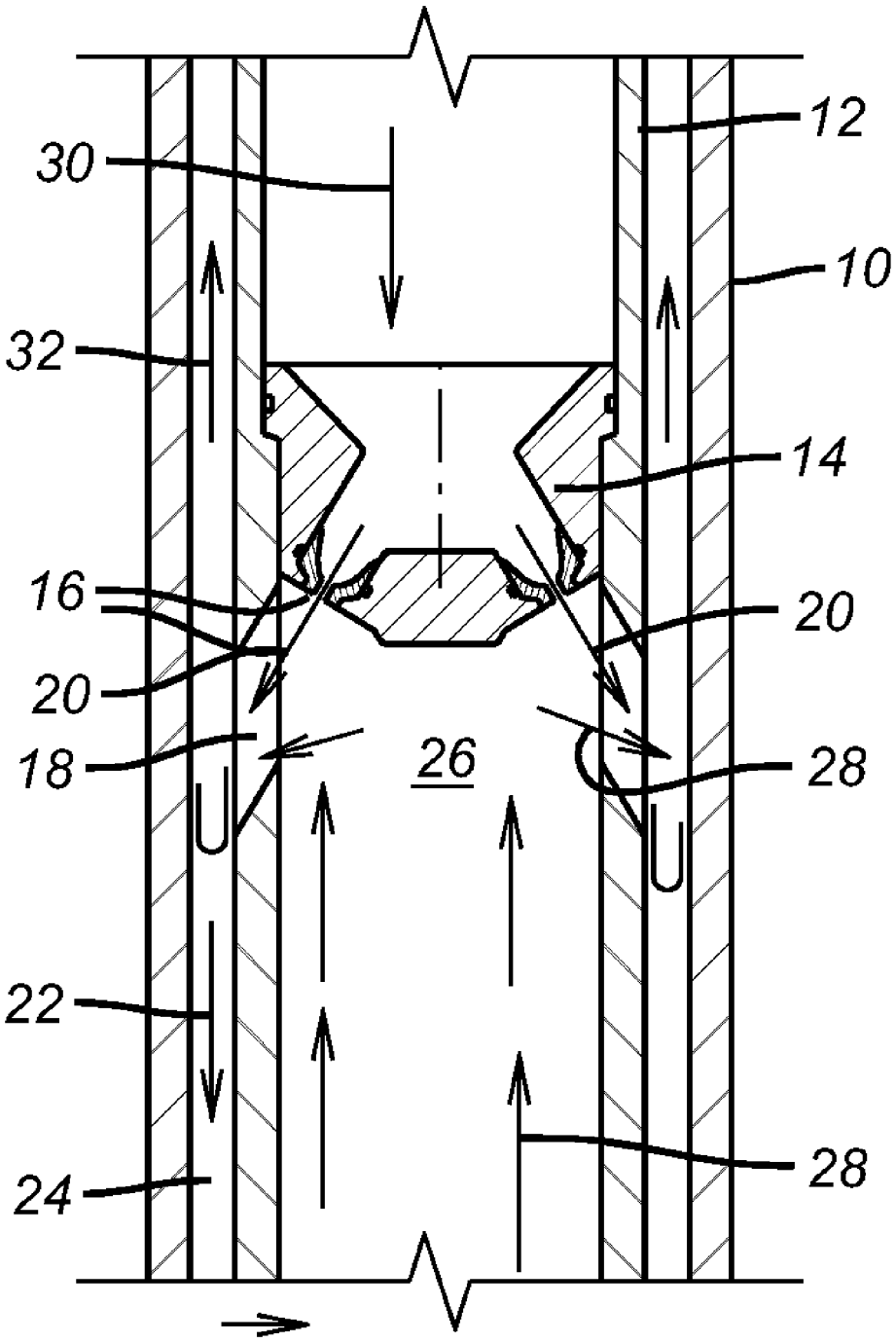
(PRIOR ART) FIG. 1
FIG. 1 is a prior art design for the jut bushing illustrated in U.S. Pat. No. 6,276,452.
Figure 2:
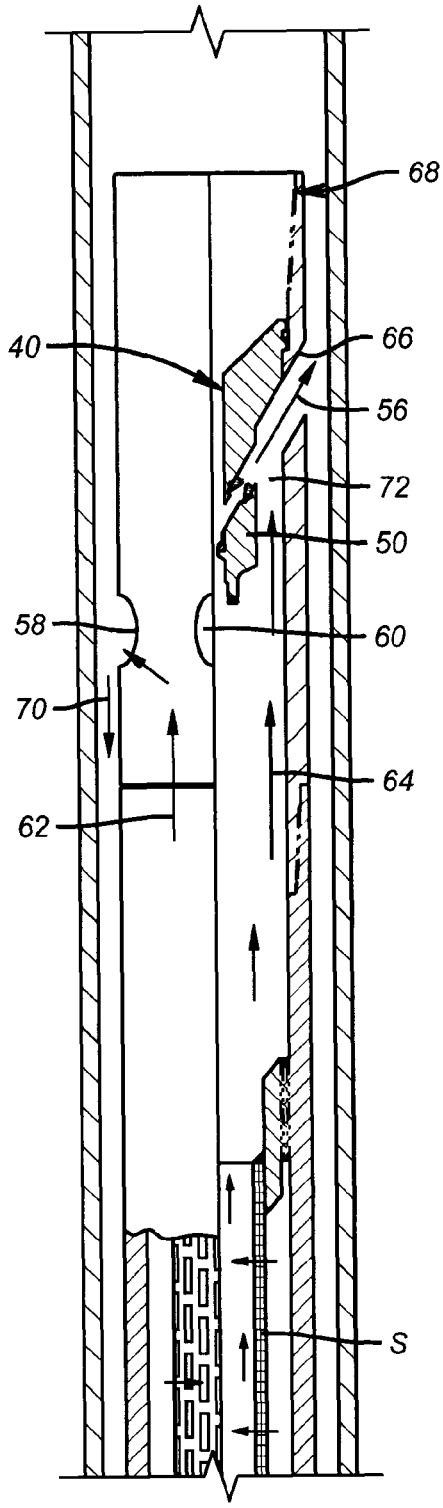
FIG. 2 is the jet bushing of the present invention showing a port looking uphole.
Figure 3:
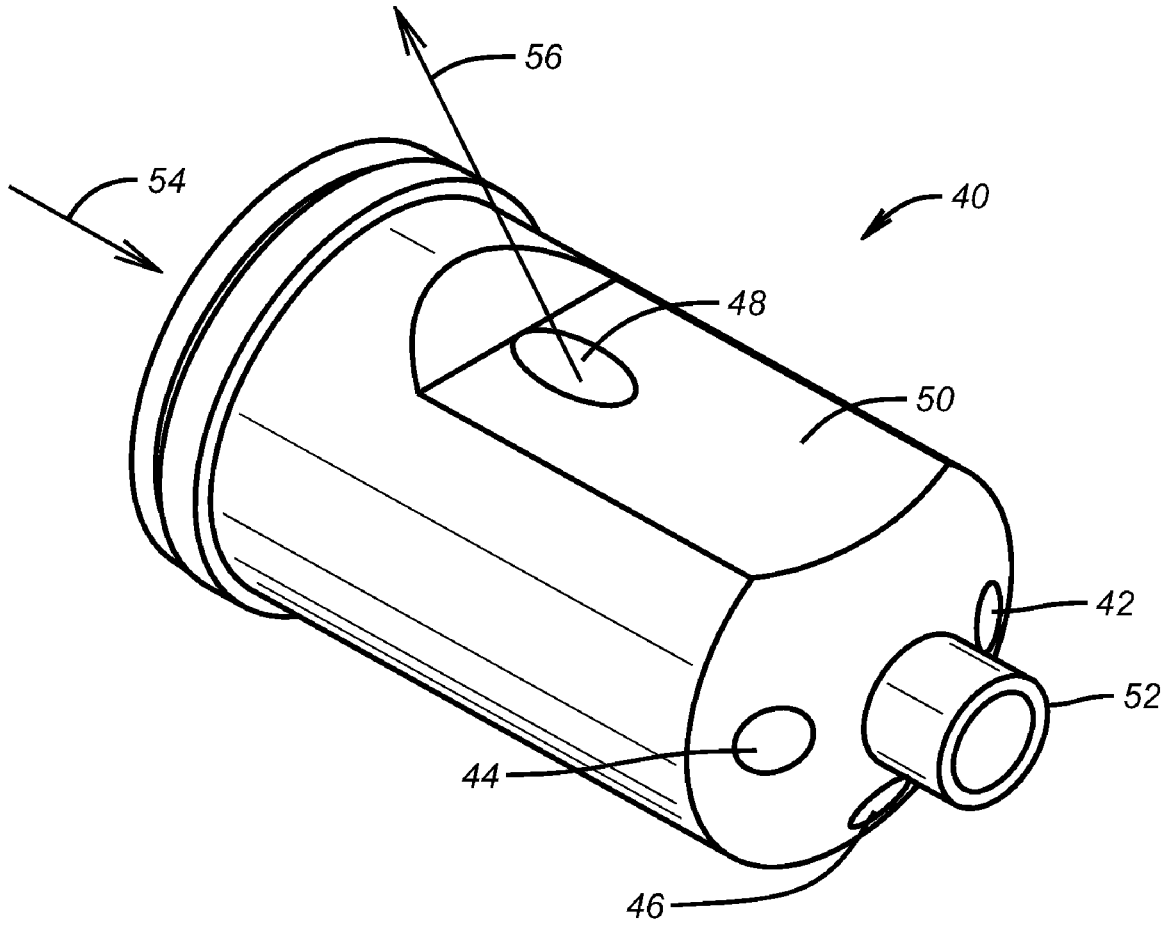
FIG. 3 is a perspective view of the jet bushing showing the orientation of its nozzles.

Referring first to FIG. 3 the jet bushing 40 is shown in perspective. It has three downhole oriented outlets 42, 44 and 46 and an uphole oriented outlet 48 that exits out of an exterior chamfer 50. A central outlet at the lower end 52 is normally plugged. Arrow 54 represents pumped flow into the jet bushing 40 generally from the surface and arrow 56 represents the returning flow to the surface. The returning flow 56 is already oriented uphole and as illustrated in FIG. 2 does not need to make a u-turn to reorient itself to go uphole as in the prior art design of FIG. 1. FIG. 2 shows ports 58 and 60 that are aligned with, for example, outlets 44 and 46 of the jet bushing 40. The rapid exit of flow from outlets 42, 44 and 46 through their respective openings such as 58 and 60 shown in FIG. 2, induces a flow stream that is represented by arrows 62 and 64. That flow has already passed through a screen S that is further down in the tool downhole. The combined flow represented by arrows 62 and 64 splits and a part 64 simply keeps going along chamfer 50 and out an uphole oriented port 66 to become part of the returning flow 56 that comes up around the outside of the cleanup tool 68 a part of which is the jet bushing 40.

Those skilled in the art can appreciate that the circulating flow from and to the surface represented by arrows 54 and 56 is not on an intersecting path with the downhole recirculation flow 70 coming out of ports 58 or 60 for example. The exiting flow 56 no longer has to make a u-turn to get to the surface, as in the FIG. 1 design. The chamfer 50 creates a passage 72 that is isolated from the exit streams from the ports such as 58 and 60. As a result, a higher recirculating flow represented by arrows 70 going down to the mill and arrows 62 and 64 that represent fluid already screened for debris removal can be achieved than with the FIG. 1 design whose turbulence due to outlet orientations reduced flow rates and as a result the efficiency of cleaning.

Those skilled in the art will appreciate that the number or size of outlets oriented downhole or uphole can be varied as well as their angular orientation with respect to the longitudinal axis of the tool.

The above description is illustrative of the preferred embodiment and many modifications may be made by those skilled in the art without departing from the invention whose scope is to be determined from the literal and equivalent scope of the claims below.

I claim:

1. A wellbore debris cleanup tool, comprising:

a body having an uphole end and a downhole end, a passage therethrough and at least one outlet oriented toward said uphole end and at least one outlet oriented toward said downhole end and located above said downhole end, said passage further comprises a screen;

a bushing mounted within said passage having exits to direct all flow in said passage entering from said uphole end to said outlets located above said downhole end thereby creating an uphole end oriented circulation loop through said uphole oriented outlet and a downhole end oriented circulation loop through said downhole oriented outlet and going down toward said lower end outside said body and then into said passage adjacent said lower end where said screen removes the debris.

2. The tool of claim 1, wherein:

said circulation loops do not intersect beyond said outlets.

3. The tool of claim 1, wherein:

flow from said bushing exit to said uphole oriented outlet draws fluid from said downhole end oriented circulation loop.

4. The tool of claim 1, wherein:

said downhole oriented circulation loop removes downhole debris.

5. A wellbore cleanup tool, comprising:

a body having an uphole end and a downhole end, a passage therethrough and at least one outlet oriented toward said uphole end and at least one outlet oriented toward said downhole end;

a bushing mounted in said passage having exits to direct flow into said passage to said outlets thereby creating an uphole end oriented circulation loop through said uphole oriented outlet and a downhole end oriented circulation loop through said downhole oriented outlet and into said passage;

said circulation loops do not intersect.

6. A wellbore cleanup tool, comprising:

a body having an uphole end and a downhole end, a passage therethrough and at least one outlet oriented toward said uphole end and at least one outlet oriented toward said downhole end;

a bushing mounted in said passage having exits to direct flow into said passage to said outlets thereby creating an uphole end oriented circulation loop through said uphole oriented outlet and a downhole end oriented circulation loop through said downhole oriented outlet and into said passage;

flow from said bushing exit to said uphole oriented outlet draws fluid from said downhole end oriented circulation loop;

said bushing comprises an exterior chamfer to create a flowpath within said passage through which said drawn fluid moves to said uphole oriented outlet.

7. The tool of claim 6, wherein:

said at least one downhole oriented outlet comprises a plurality of downhole oriented outlets.

8. The tool of claim 7, wherein:

said bushing comprises an exit for each said downhole oriented outlets.

9. The tool of claim 8, wherein:

said bushing comprises an exit for each uphole oriented outlet.

10. The tool of claim 9, wherein:

said at least one uphole oriented outlet comprises a plurality of uphole oriented outlets.

11. The tool of claim 10, wherein:

said downhole oriented circulation loop removes downhole debris.

12. A wellbore cleanup tool, comprising:

a body having an uphole end and a downhole end, a passage therethrough and at least one outlet oriented toward said uphole end and at least one outlet oriented toward said downhole end;

a bushing mounted in said passage having exits to direct flow into said passage to said outlets thereby creating an uphole end oriented circulation loop through said uphole oriented outlet and a downhole end oriented circulation loop through said downhole oriented outlet and into said passage;

flow from said bushing exit to said uphole oriented outlet draws fluid from said downhole end oriented circulation loop;

some of the flow through said bushing exit that goes through said downhole oriented outlet exits said body from said passage through said uphole oriented exit.

* * * * *